US006192843B1

(12) United States Patent
Laufenberg et al.

(10) Patent No.: US 6,192,843 B1
(45) Date of Patent: Feb. 27, 2001

(54) ANGULAR ADJUSTMENT DEVICE

(75) Inventors: Dietmar Laufenberg, Windeck-Hurst; Rainer Steinberg, Leverkusen, both of (DE)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/446,387

(22) PCT Filed: Jul. 21, 1997

(86) PCT No.: PCT/EP97/03919

§ 371 Date: Dec. 21, 1999

§ 102(e) Date: Dec. 21, 1999

(87) PCT Pub. No.: WO98/04812

PCT Pub. Date: Feb. 5, 1998

(30) Foreign Application Priority Data

Jul. 26, 1996 (DE) ..... 196 30 174

(51) Int. Cl.[7] ..... F01L 1/344

(52) U.S. Cl. ..... 123/90.17; 123/90.31; 74/568 R

(58) Field of Search ..... 123/90.15, 90.16, 123/90.17, 90.31; 74/568 R; 464/1, 2, 160

(56) References Cited

U.S. PATENT DOCUMENTS 5,823,152 * 10/1998 Ushida ..... 123/90.17

* cited by examiner

*Primary Examiner*—Wellun Lo
(74) *Attorney, Agent, or Firm*—Frank G. McKenzie

(57) ABSTRACT

A device for adjustment of the angular position of a shaft, preferably a camshaft of an internal combustion engine, relative to a driving wheel, comprising an adjusting device for adjustment of the angular position starting from a base position and comprising an arresting device for arresting the angular position in the base position is proposed. Between components (2, 3) capable of being respectively connected non-rotatably to the shaft and to the driving wheel, an interface (11) located eccentrically to the shaft and having a longitudinal extension running circumferentially of the shaft is provided. One part of the arresting device is formed as an arresting pin element (13) movable at an angle to the interface and the other part as an arresting recess (39) into which a portion of the arresting pin element (13) can engage when in the base position, the arresting pin element being mechanically preloaded in the engagement direction and being movable counter to the engagement direction by the pressure of a control fluid.

8 Claims, 2 Drawing Sheets

ANGULAR ADJUSTMENT DEVICE

FIELD OF THE INVENTION

The invention relates to a device for adjustment of the angular position of a shaft, preferably a camshaft of an internal combustion engine, relative to a driving wheel, comprising an adjusting device for adjustment of the angular position starting from a base position and comprising an arresting device for arresting the angular position in the base position, said adjusting device including at least one first component capable of being connected non-rotatably to the shaft and at least one second component capable of being connected non-rotatably to the driving wheel, said components being angularly adjustable relative to one another along an interface, the arresting device including at least two interengaging parts one of which is located in the first component and the second in the second component.

BACKGROUND OF THE INVENTION AND PRIOR ART

Angular adjustment devices are often used in internal combustion engines in order to shift the position of the camshaft relative to the crankshaft by a predetermined angle. The camshafts operate the valves according to the profile of their cams, the resulting fixed valve control times merely representing a compromise, above all with respect to the rated power, torque, fuel consumption and exhaust gas emission requirements of the internal combustion engine. The phase shift of the control times associated with the adjustment in the angular adjustment serves the purpose of optimisation.

The angular adjustment is mostly effected hydraulically, and a fall in the hydraulic pressure below a lower limiting value may lead to undesired positions of the camshaft relative to the crankshaft, which are accompanied by high loads on the components. In order to avoid undesired positions of the camshaft in case of inadequate hydraulic supply it is known to provide a device which, if the hydraulic pressure is too low, brings the camshaft into a base position and arrests it in this position until the oil pressure has reached an adequate value for stable control of the system, for example after starting the internal combustion engine. Otherwise, it can in fact happen that until the predetermined oil pressure has been reached an uncontrolled angular adjustment occurs which in case of a possibly necessary repetition of the starting of the internal combustion engine leads to starting problems.

German Offenlegungsschrift 39 37 644 discloses a device for hydraulic angular adjustment in which an impeller wheel attached coaxially on the shaft side is received in a cellular wheel secured on the driving wheel side. A device for arresting the shaft in its base position includes a slidably movable arresting sleeve located coaxially in the cellular wheel or impeller wheel and held non-rotatably by means of a locking profile, and blocking grooves located in the respective counterpart wheel and aligned with the locking profile, the arresting sleeve being moved out of the arresting position by a servomotor. A disadvantage of this device is that it requires a relatively large amount of space in the axial direction of the shaft and is expensive to make both mechanically and in respect of control technology.

OBJECT OF THE INVENTION

In contrast to this, the object of the invention is to improve a device of the kind referred to so that it needs less space and is of simpler design.

SUMMARY OF THE INVENTION

In accordance with the invention, to achieve this object the at least two parts of the arresting device are located between the components in an interface located eccentrically to the shaft and having a longitudinal extent running circumferentially of the shaft, the one part being formed as an arresting pin element movable at an angle to the interface and the other part as an arresting recess into which a portion of the arresting pin element can engage when in the base position, the arresting element being mechanically preloaded in the engagement direction and being movable counter to the engagement direction by the pressure of a control fluid.

Locating the arresting device eccentrically of the shaft makes it possible to take up the arresting forces in the cross sectional area of the arresting pin element by means of a shearing load. The load can thereby be carried in a smaller region than in the case of projections located on the circumferential surface. In addition to this, the arresting pin element no longer has to be a hollow section surrounding the shaft, but can be designed as a full section, thus enabling the space required to be further reduced. Since the arresting device is offset radially outwards and accordingly can be located beside the shaft, both the space required for axial prolongation of the shaft and also (depending on the radial distance selected) the dimensions are reduced, since the forces to be taken up become less as the distance becomes greater, i.e. as the lever arm becomes longer. In addition the arresting device, absent the need to provide a cavity, merely includes an arresting pin element and an arresting recess, so that the arresting device does not require any difficult working or surface shaping and the manufacturing costs can be considerably reduced. Since the arresting pin is arranged and movable at an angle to the interface, and the angle does not need to be 90° but can have an arbitrary value, the site and position of the arresting device can be adapted as desired to the constructional specifications or requirements. A further saving of space and simplification of the construction is achieved in that the arresting pin element is mechanically preloaded into the engaging position and is movable in the other direction by means of a control fluid. Separate motorised driving devices are not necessary. Another consequence of this is increased operational reliability in the case of a device in accordance with the invention, since any sources of error, for example failure of a driving motor for actuation of the arresting device, are excluded right from the beginning.

Preferably the two components exhibit regions of flange-like form between which there extends an interface running substantially radially in which the arresting device is located. This makes for further simplification, since only substantially perpendicular surfaces have to be produced.

In a preferred further embodiment of the invention the arresting pin element is movable in the longitudinal direction of the shaft. This measure also greatly limits the space requirements in the radial direction.

Preferably several arresting pin elements and associated arresting recesses are arranged round the circumference of the shaft. This measure gives a conforming distribution of the forces occurring, and particularly in the case of uniform distribution of the arresting pin elements and recesses a uniform distribution of the forces is also achieved.

In a further advantageous development of the invention the two components exhibit assembly recesses opening into the interface and coinciding when in the base position. In the case of a substantially radially extending interface between the two components it is particularly preferred that these recesses extend substantially in the longitudinal direction of the shaft. The assembly recesses serve to align or "zero" the parts of the whole system with all its tolerances both for the initial assembly and also in subsequent servicing. During the assembly and/or the servicing an assembly pin element can be pushed into the assembly recesses. The components can thus be simply twisted relative to one another until the desired base position is reached in which the arresting pin element lies opposite the arresting recess. In this position the whole device can be fixed in position, for example by means of a necked-down bolt by means of which the components are connected to the end face of a camshaft, whereby the tolerances in the device are compensated. This is particularly advantageous in the case of mass production, with its inevitable tolerances.

Providing a plurality of assembly recesses arranged around the circumference of the shaft again makes a more uniform force initiation possible.

Advantageously the arresting pin element includes an arresting pin carried on a piston which is spring loaded in the engagement direction and hydraulically movable in the opposite direction. This leads to a particularly simple design of the arresting device.

BRIEF DESCRIPTION OF THE DRAWINGS

The invention will now be described in more detail, by way of example, with reference to the drawings, in which.

DETAILED DESCRIPTION OF A PREFERRED EMBODIMENT OF THE INVENTION

Figure 1:
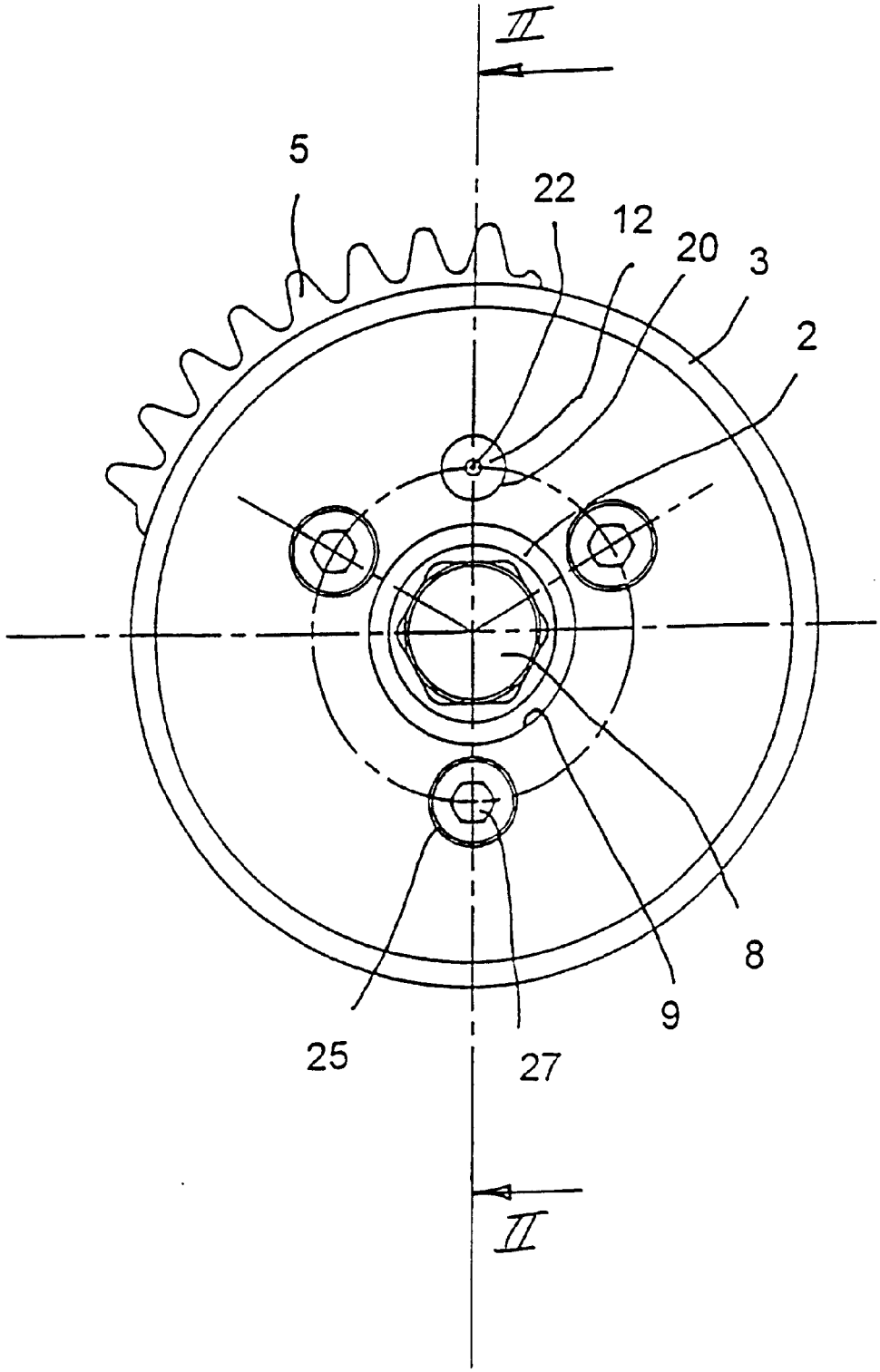
FIG. 1 is a diagrammatic front view of an angular adjustment device in accordance with the invention, in the direction of the arrow A in FIG. 2.
Figure 2:
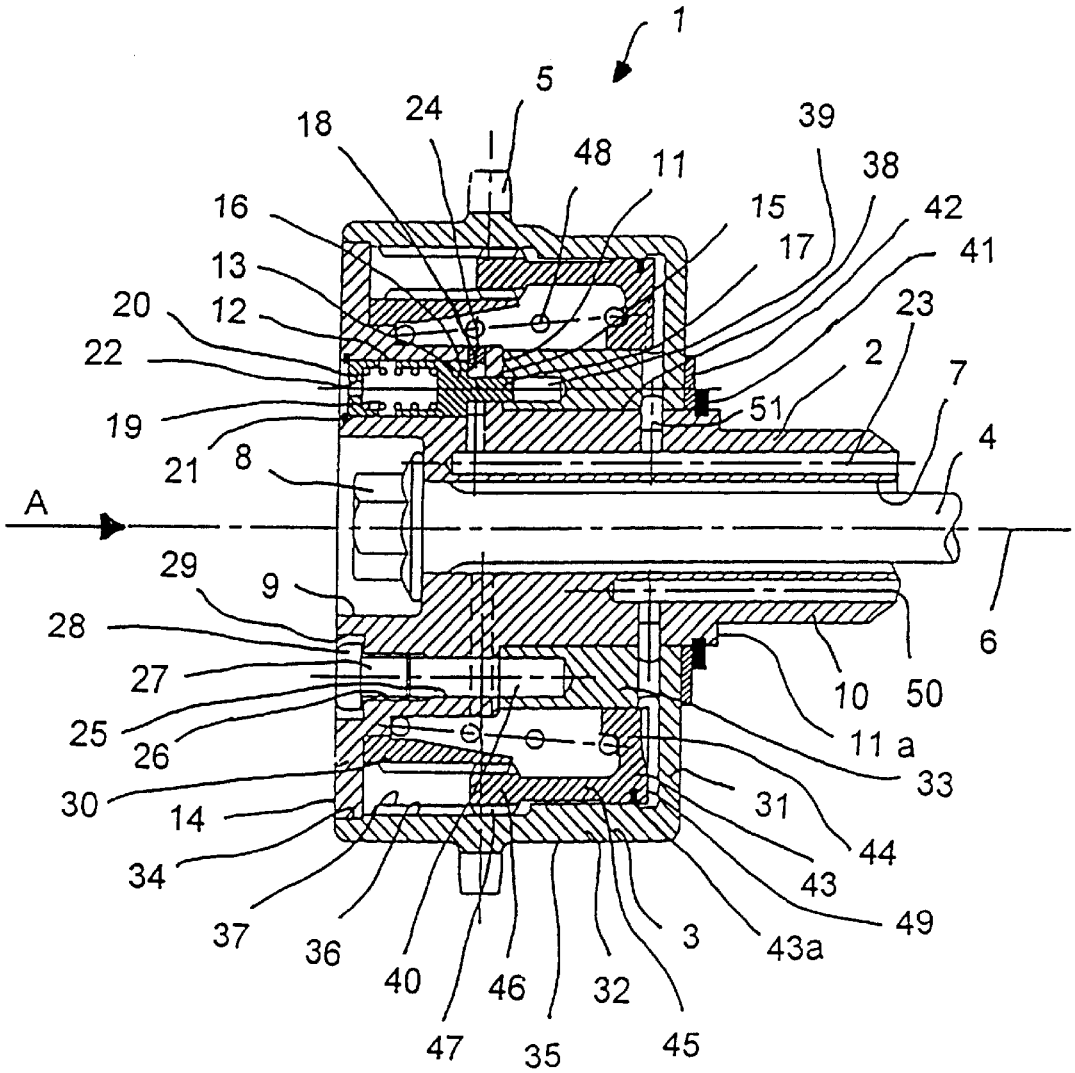
FIG. 2 is a section through the device of FIG. 1 along the line II—II.

The device 1 shown in the Figures for adjustment of the angular position of a shaft (not shown) relative to a driving wheel (not shown) includes as a first component a body 2 which is connected non-rotatably to the shaft and as a second component a tooth carrier 3 which is connected non-rotatably to the driving wheel. The non-rotatable connection of the body 2 to the shaft is effected by means of a securing bolt 4 which in the case shown is in the form of a necked-down bolt. The tooth carrier 3 is in the form of a chain wheel or toothed belt wheel, with the torsion-resistant connection to the driving wheel taking place through teeth 5 arranged on the circumference of the tooth carrier 3.

The body 2 forms an extension of the shaft and is fitted on to one end face of the shaft, coaxially to the axis of rotation 6 of the shaft, and has a coaxial through opening 7 through which the securing bolt 4 passes. This is screwed to the end face (not shown) of the shaft, with its head sunk in a recess 9 in the end face 14 of the body 2 which faces away from the shaft. The body 2 includes several cylindrically shaped portions 10 having external diameters which become smaller from the end face 14 towards the shaft. The portions 10 are connected together by radially extending shoulder faces 11*a*. A recess 12, spaced radially from the axis of rotation 6 there is provided a recess 12 and in the present case cylindrical, is provided for an arresting pin element 13. Several such recesses 12 can also be provided on a circle around the bolt or around the shaft, for example three recesses offset circumferentially to one another by 120°, as can best be seen from FIG. 1. The recess 12 shown extends from the end face 14 of the body 2 which faces away from the shaft and leads through an opening 15, the width of which is less than the width of the recess 12, into a radial, flange-like shoulder face 11 which constitutes an interface.

The arresting or locking pin element 13 is in the form of a cylindrical piston 16 on the end face (facing the shaft) of which an arresting pin 17 is arranged centrally. The diameter of this pin is less than that of the piston 16 so that a shoulder face 18 is similarly formed between the arresting pin 17 and the piston 16. Bearing against the side of the piston 16 facing away from the shaft is one end of a pressure spring 19, the other end of which bears against a backing plate 20 which in turn is held in the recess 12 by means of a retaining ring 21. The pressure spring is pressure loaded and consequently exerts a pressure on the piston 16 in the longitudinal direction of the shaft, i.e. in the direction of the axis of rotation 6. A central opening 22 is formed in the backing plate 20. A first hydraulic fluid duct 23 runs through the body 2, first in the longitudinal direction of the shaft and then continues radially towards the arresting pin 17 at the level of the shoulder face 18 between the piston 16 of the arresting pin element 13 and the arresting pin 17, finally opening into the circumferential surface of the body 2. In the starting position of the arresting pin element 13, i.e. in the base position of the shaft, the wall of the radial portion of the duct 23 lies flush with said shoulder face 18. The mouth opening is closed by a stopper 24, which projects somewhat into the recess 12 for the arresting pin element 13, so that in the starting position the arresting pin element 13 has its shoulder face 18 against the stopper 24 and can be brought into contact with the hydraulic fluid.

On the same circle on which the arresting pin element or elements 13 is/are arranged assembly recesses are formed (between the arresting pin elements if there are several of these, and if there are three of them, likewise offset from one another by 120°) into which, both for the initial assembly and also in the case of subsequent service work, an assembly pin element can be pushed. The ends of the assembly recesses 25 opening into the end face 14 of the body 2 are each provided with an internal screw thread 26 into which a screw plug 27 can be screwed, for example in order to close these assembly recesses 25 in the operating state of the angular adjusting device. The head 28 of the screw plug 27 is sunk into a recess 29 on the end face 14, facing away from the shaft, of the body 2.

Radially further out than the arresting pin element 13 and the assembly devices 25 the body 2 is provided with tooth elements 30 which are in engagement with the tooth elements of the tooth carrier 3.

The tooth carrier 3 exhibits on its side facing the shaft a radially extending portion 31, starting from which extend a radially outer first circumferential portion 32 running longitudinally of the shaft and a second, radially inner, circumferential portion 33, likewise running longitudinally of the shaft. The first circumferential portion 32 bears on the circumferential face 34 of the portion of the body with the largest external diameter, which forms the end face 14 (facing away from the shaft) of the body 2. To the outer circumferential face 35 of this first circumferential portion 32 there is attached a tooth circle 5, which can be brought into engagement with the teeth of the driving wheel. On the inner circumferential surface 36 of the first circumferential portion 32 teeth 37 are formed which lie radially opposite the tooth element 30 of the body 2.

The radially inner second circumferential portion 33 bears with its radially inner surface 38 against the outer surface of one of the cylindrical portions of the body 2 and, in the case shown, includes an arresting recess 39 which, in the starting position, is aligned with the arresting pin 17 of the arresting pin element 13. The internal diameter of this arresting recess 39 is made such that it can receive the arresting pin 17 as far as possible without any play. Offset by 60° and 180° respectively from this arresting recess 39 this second circumferential portion 33 of the tooth carrier 3 is provided with three assembly recesses 40 arranged on a circle, which in the starting position are aligned with the assembly recesses 25 in the body 2, the diameter of the assembly recesses 40 in the tooth carrier 3 being the same as the diameter of the assembly recesses in the body 2. The arresting recess 39 is likewise arranged on this circle. In the longitudinal direction of the shaft the tooth carrier 3 is held relative to the body 2 by means of a retaining ring 41, a sliding washer 42 being provided between the retaining ring 41 and the radially extending portion 31 of the tooth carrier 3 in order to facilitate radial movement of the tooth carrier 3 relative to the body 2.

Between the two circumferential portions 32, 33 of the tooth carrier 3 is arranged an L-shaped piston 43 of which the shorter limb 44 runs parallel to the radial portion 31 and the longer limb 45 runs parallel and adjacent to the outer circumferential portion 32. To seal the gap between the piston 43 and the outer circumferential portion 32 a piston seal 43*a* is provided. The end region 46, facing away from the shaft, of the long limb 45 of the piston has teeth 47 on its inner and on its outer circumferential surface which mesh respectively with the teeth 30 on the body and with the teeth 37 formed on the inner surface 36 of the outer circumferential portion 32. Between a radial shoulder face of the body 2 and the short limb 44 of the piston 43 there is located a return spring 48, preloaded under pressure, which urges the piston towards the shaft. The teeth between the body 2, the piston 43 and the tooth carrier 3 are in the form of a helical tooth system, by means of which the angular adjustment takes place under hydraulic control. For this purpose the face 49 of the short limb 44 of the piston 43, facing towards the shaft, can be acted on by a hydraulic fluid which can be supplied by means of a second hydraulic fluid duct 50 and through a duct 51 branching in the radial direction from the first hydraulic duct 23.

The preload of the return spring 48 is adjusted so that the piston 43 is forced into its starting position if the hydraulic pressure falls below a predetermined value. With the movement of the piston 43 into its starting position the angular adjustment device 1 is brought into its base position by means of the helical gearing 30, 37, 47, whereby the arresting pin 17 and the arresting recess 39 come to coincide and the arresting pin 17 is caused to engage in the arresting recess 39 by the pressure spring 19. Since the two hydraulic ducts 23, 50 are in fluid connection with one another, the same hydraulic pressure is applied to the piston 16 of the arresting pin element as to the piston 43 for the angular adjustment. The preloading force of the pressure spring 19 is adjusted so that the arresting pin 17 is forced out of the arresting recess 39 by the hydraulic pressure when the hydraulic pressure reaches a level sufficient to control the system stably through the tooth system between the body 2 and the tooth carrier 3. The effect of the arresting device thus ceases when this predetermined hydraulic pressure is reached, so that the angular adjustment then takes place by way of the helical gearing and the hydraulic control.

What is claimed is:

1. A device for adjustment of an angular position of a camshaft of an internal combustion engine relative to a driving wheel, comprising an adjusting device including a piston moveable in the axial direction of the camshaft for adjustment of the angular position starting from a base position and comprising an arresting or locking device for arresting the angular position in the base position, said adjusting device including at least one first component capable of being connected non-rotatably to the camshaft and at least one second component capable of being connected non-rotatably to the driving wheel, said components being angularly adjustable relative to one another along an interface, the arresting device including at least two interengaging parts one of which is located in the first component and the second in the second component, characterized in that the at least two parts (13, 39) of the arresting device are located between the components (2,3), and that the one part is formed as an arresting or locking pin element (13) movable at an angle to the interface (11) and the outer part as an arresting recess (39) into which a portion of the arresting pin element (13) can engage in the base position, the arresting pin element (13) being mechanically preloaded in the engagement direction and being movable counter to the engagement direction by the pressure of a control fluid.

2. A device according to claim 1, characterised in that said two components (2, 3) exhibit regions of flange-like form between which there extends a substantially radially extending interface (11) in which the arresting device is located.

3. A device according to claim 2, characterised in that the arresting pin element (13) is movable longitudinally of the camshaft.

4. A device according to claim 1, characterised in that several arresting pin elements (13) and associated arresting recesses (39) are arranged round the circumference of the camshaft.

5. A device according to claim 1, characterised in that the two components (2, 3) are provided with assembly recesses (25, 40) opening into the interface and coinciding when in the base position.

6. A device according to claim 5, characterized in that the assembly recesses (25,40) run longitudinally of the camshaft.

7. A device according to claim 1, characterised in that a plurality of assembly recesses (25, 40) are provided, arranged circumferentially of the camshaft.

8. A device according to claim 1, characterised in that the arresting pin element (13) includes an arresting pin (17) carried on a piston (16) which is spring loaded in the engagement direction and hydraulically movable in the opposite direction.

* * * * *